US011815849B2

(12) United States Patent
Mori et al.

(10) Patent No.: US 11,815,849 B2
(45) Date of Patent: Nov. 14, 2023

(54) ELECTROPHOTOGRAPHIC PHOTOSENSITIVE MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Haruki Mori, Chiba (JP); Naoaki Ichihashi, Chiba (JP); Kenichi Ikari, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/051,584

(22) Filed: Nov. 1, 2022

(65) Prior Publication Data

US 2023/0152719 A1 May 18, 2023

(30) Foreign Application Priority Data

Nov. 17, 2021 (JP) ..... 2021-187387

(51) Int. Cl.

| | |
|---|---|
| ***G03G 15/22*** | (2006.01) |
| ***G03G 5/05*** | (2006.01) |
| ***G03G 15/16*** | (2006.01) |
| ***G03G 21/18*** | (2006.01) |
| ***G03G 15/02*** | (2006.01) |

(52) U.S. Cl.

CPC ..... *G03G 5/0521* (2013.01); *G03G 15/0233* (2013.01); *G03G 15/1605* (2013.01); *G03G 21/1842* (2013.01); *G03G 2215/1604* (2013.01); *G03G 2215/1647* (2013.01)

(58) Field of Classification Search

CPC ..... G03G 5/047; G03G 5/0521; G03G 5/056; G03G 5/0564; G03G 5/087; G03G 15/0233; G03G 15/1505; G03G 21/1842; G03G 2215/1604; G03G 2215/1647

See application file for complete search history.

(56) References Cited

U.S. PATENT DOCUMENTS

| | | | |
|---|---|---|---|
| 9,389,521 | B2 | 7/2016 | Takahashi |
| 9,594,318 | B2 | 3/2017 | Nakata |
| 9,766,561 | B2 | 9/2017 | Takahashi |
| 9,817,324 | B2 | 11/2017 | Kitamura |
| 9,971,258 | B2 | 5/2018 | Kitamura |
| 10,042,272 | B2 | 8/2018 | Mori |

(Continued)

FOREIGN PATENT DOCUMENTS

| | | | |
|---|---|---|---|
| JP | 10268535 | A | 10/1998 |
| JP | 2000-66425 | A | 3/2000 |

OTHER PUBLICATIONS

U.S. Appl. No. 18/156,611, Ryoichi Tokimitsu, filed Jan. 30, 2023.

(Continued)

*Primary Examiner* — Hoang X Ngo
(74) *Attorney, Agent, or Firm* — VENABLE LLP

(57) ABSTRACT

It is an object of the present invention to provide an electrophotographic photosensitive member capable of suppressing the environmental fluctuation in the electrical characteristics. The present invention provides the electrophotographic photosensitive member in which the surface layer contains the compound having the specific structure.

12 Claims, 2 Drawing Sheets

(56) References Cited

U.S. PATENT DOCUMENTS

| | | | | |
|---|---|---|---|---|
| 10,042,273 | B2 | 8/2018 | Takahashi | |
| 10,120,331 | B2 | 11/2018 | Nakata | |
| 10,310,395 | B2 | 6/2019 | Nakata | |
| 10,359,729 | B2 | 7/2019 | Ichihashi | |
| 10,365,569 | B2 | 7/2019 | Tokimitsu | |
| 10,451,984 | B2 | 10/2019 | Mori | |
| 10,488,769 | B2 | 11/2019 | Nakata | |
| 10,488,771 | B2 | 11/2019 | Mori | |
| 10,558,132 | B2 | 2/2020 | Ishiduka | |
| 10,558,133 | B2 | 2/2020 | Nakamura | |
| 10,670,979 | B2 | 6/2020 | Nakata | |
| 10,705,441 | B1 * | 7/2020 | Fujii | G03G 5/0603 |
| 10,761,442 | B2 | 9/2020 | Nakata | |
| 10,768,539 | B2 | 9/2020 | Mori | |
| 10,831,118 | B2 | 11/2020 | Watanabe | |
| 10,895,840 | B2 | 1/2021 | Ichihashi | |
| 10,969,703 | B2 | 4/2021 | Takeuchi | |
| 10,976,677 | B2 | 4/2021 | Tokimitsu | |
| 11,029,615 | B2 | 6/2021 | Mitsui | |
| 11,029,616 | B2 | 6/2021 | Kujirai | |
| 11,169,453 | B2 | 11/2021 | Takeuchi | |
| 11,204,560 | B2 | 12/2021 | Tokimitsu | |
| 11,237,494 | B2 * | 2/2022 | Mori | C09J 133/14 |
| 11,269,282 | B2 | 3/2022 | Ikari | |
| 2020/0096883 | A1 * | 3/2020 | Nonaka | G03G 5/14726 |
| 2020/0159136 | A1 | 5/2020 | Mori | |
| 2020/0249590 | A1 | 8/2020 | Nakata | |
| 2020/0341394 | A1 | 10/2020 | Ikari | |
| 2021/0033992 | A1 | 2/2021 | Kaku | |
| 2021/0302847 | A1 | 9/2021 | Ichihashi | |

OTHER PUBLICATIONS

U.S. Appl. No. 18/161,115, Toshiyasu Shirasuna, filed Jan. 30, 2023.

U.S. Appl. No. 18/161,328, Jun Ohira, filed Jan. 30, 2023.

* cited by examiner

ELECTROPHOTOGRAPHIC PHOTOSENSITIVE MEMBER, PROCESS CARTRIDGE AND ELECTROPHOTOGRAPHIC IMAGE FORMING APPARATUS

BACKGROUND OF THE INVENTION

Field of the Invention

The present invention relates to an electrophotographic photosensitive member, a process cartridge having the electrophotographic photosensitive member and an electrophotographic image forming apparatus having the electrophotographic photosensitive member.

Description of the Related Art

Extensive investigations have been conducted on electrophotographic photosensitive members, especially organic electrophotographic photosensitive members (hereafter, electrophotographic photosensitive members refer to organic electrophotographic photosensitive members) containing organic photoconductive substances as charge generating substances, to be installed on an electrophotographic image forming apparatus (hereafter also referred to as "electrophotographic apparatus"). In recent years, with the increase in printing speed, there has been a demand for an electrophotographic photosensitive member having a longer life. Japanese Patent Application Laid-Open No. H10-268535 and Japanese Patent Application Laid-Open No. 2000-66425 describe the electrophotographic photosensitive members with surface layers exhibiting excellent mechanical strength.

As a result of careful study by the inventors of the present invention, it was found that the electrophotographic photosensitive members described in Japanese Patent Application Laid-Open No. H10-268535 and Japanese Patent Application Laid-Open No. 2000-66425 have large differences in the electrical characteristics caused by the differences in the use environments. In particular, the difference between the high temperature and high humidity environments and the low temperature and low humidity environments (environmental fluctuation) was remarkable. When the environmental fluctuation is large, the image density changes when the use environment changes, so the electrophotographic photosensitive member capable of suppressing the environmental fluctuation is required.

SUMMARY OF THE INVENTION

Therefore, it is an object of the present invention to provide an electrophotographic photosensitive member capable of suppressing the difference in the electrical characteristics caused by the differences in the use environment (environmental fluctuation). Furthermore, it is an object of the present invention to provide a process cartridge and an electrophotographic apparatus having the electrophotographic photosensitive member.

The above object is achieved by the following present invention. That is, the electrophotographic photosensitive member according to the present invention is an electrophotographic photosensitive member including a support and a surface layer, wherein the surface layer contains a compound represented by the following formula (1):

(1)

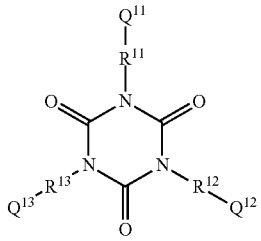

where, in the formula (1), $R^{11}$ to $R^{13}$ each independently represent an alkylene group having 1 to 6 carbon atoms, and $Q^{11}$ to $Q^{13}$ each independently represent a hydroxy group or a carboxy group.

In addition, the process cartridge according to the present invention is a process cartridge including the electrophotographic photosensitive member and at least one unit selected from the group consisting of a charging unit, a developing unit, a transfer unit, and a cleaning unit, the process cartridge integrally supporting the electrophotographic photosensitive member and the at least one unit, and being detachably attachable to a main body of an electrophotographic apparatus.

Moreover, the electrophotographic apparatus according to the present invention is an electrophotographic apparatus having the electrophotographic photosensitive member and a charging unit, an exposing unit, a developing unit and a transfer unit.

Further features of the present invention will become apparent from the following description of exemplary embodiments with reference to the attached drawings.

DESCRIPTION OF THE EMBODIMENTS

Figure 1:
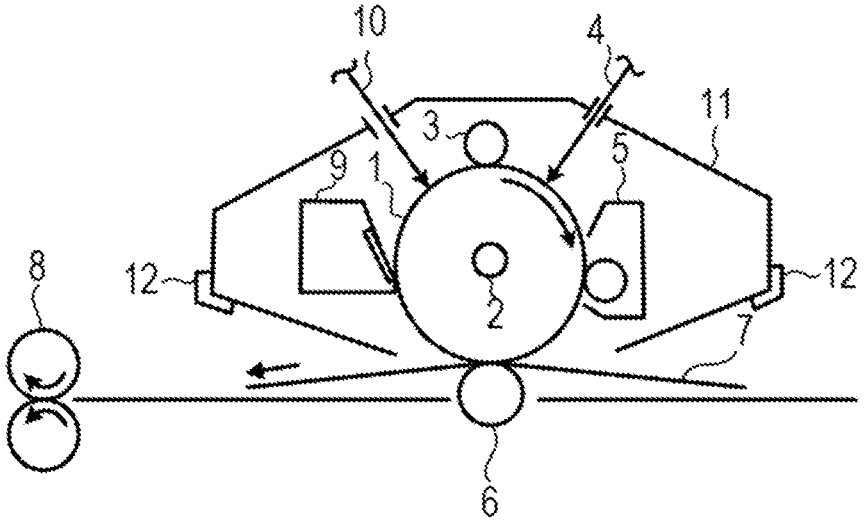
FIG. 1 is a view for illustrating an example of the schematic configuration of an electrophotographic apparatus equipped with a process cartridge having an electrophotographic photosensitive member of the present invention.

Hereafter, the present invention will be described in detail with reference to the preferred embodiment.

An electrophotographic photosensitive member according to one aspect of the present invention includes the surface layer which contains a compound represented by the following formula (1):

(1)

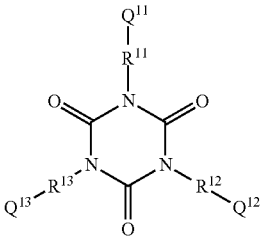

where, in the formula (1), $R^{11}$ to $R^{13}$ each independently represent an alkylene group having 1 to 6 carbon atoms, and $Q^{11}$ to $Q^{13}$ each independently represent a hydroxy group or a carboxy group.

The inventors of the present invention speculate the reason for achieving the effect of the present invention by the presence of the above features as follows.

It is assumed that the difference in the electrical characteristics of the electrophotographic photosensitive members caused by the difference in the use environments (environmental fluctuation) becomes significant because the effects of moisture penetrating the surface layer and reaching the lower layer on the charge generating substance in the photosensitive layer differ depending on the use environments. In particular, since the absolute moisture contents in the use environments vary greatly between the high temperature and high humidity environments and the low temperature and low humidity environments, the effects of moisture on the charge generating substances become different, leading to greater environmental fluctuation.

The electrophotographic photosensitive member of the present invention contains the compound represented by the following formula (1) in the surface layer thereof:

(1)

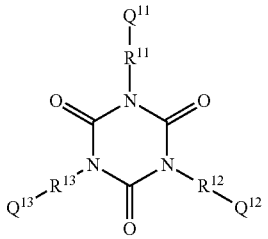

where, in the formula (1), $R^{11}$ to $R^{13}$ each independently represent an alkylene group having 1 to 6 carbon atoms, and $Q^{11}$ to $Q^{13}$ each independently represent a hydroxy group or a carboxy group.

The compound represented by the formula (1) has a hydroxy group or a carboxy group. Hydroxy or carboxy groups are highly hydrophilic, which makes it easier for moisture that has penetrated the surface layer to be attracted to the compound represented by the formula (1). In addition, the compound represented by the formula (1) has an isocyanuric ring skeleton. Since an isocyanuric ring skeleton has high polarity, it easily forms a hydrogen bond with a water molecule. The inventors of the present invention speculate that the synergistic effect of the hydroxy or carboxy group with the isocyanuric ring skeleton can suppress moisture that has penetrated the surface layer reaching the lower layer, thereby suppressing the environmental fluctuation.

Specific examples of the compound represented by the formula (1) (exemplary compounds 1-1 to 1-10) are given below, but the present invention is not limited to these.

(1-1)

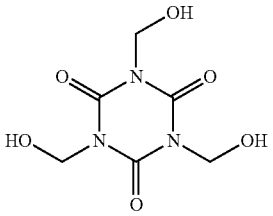

-continued (1-2)

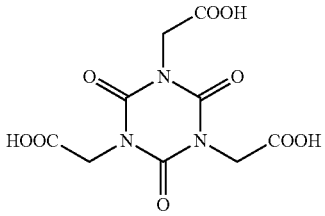

(1-3)

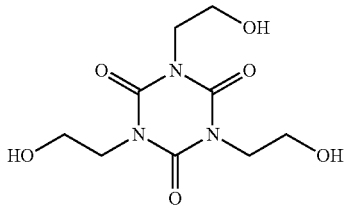

(1-4)

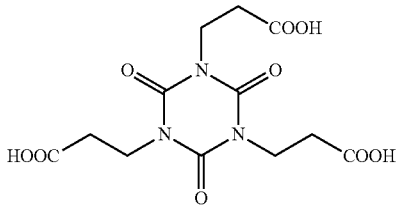

(1-5)

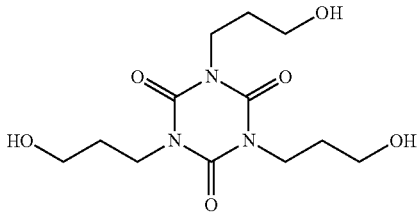

(1-6)

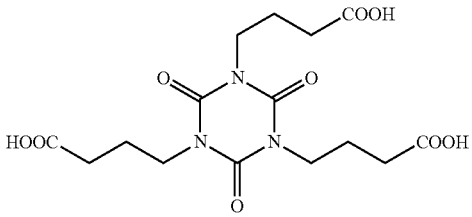

(1-7)

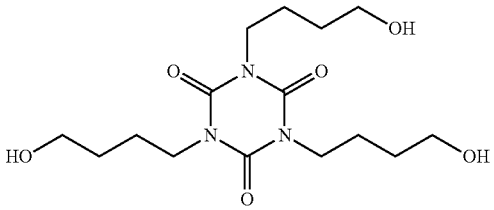

(1-8)

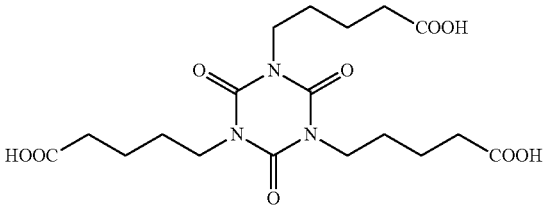

-continued (1-9)

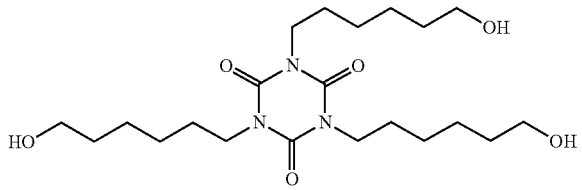

(1-10)

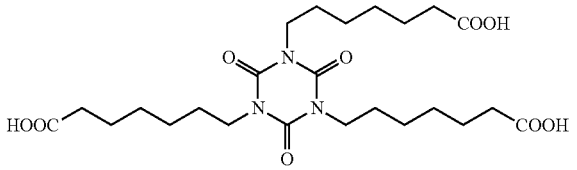

The content of the compound represented by the formula (1) in the surface layer is preferably 0.01 to 1% by mass based on the total mass of the surface layer. It is speculated that within this range, both the ease of moisture penetration into the surface layer and the suppression of moisture reaching the lower layer can be achieved with good balance, thereby suppressing the environmental fluctuation. More preferably, the content of the compound represented by the formula (1) in the surface layer is 0.01 to 0.5% by mass based on the total mass of the surface layer.

Furthermore, in the compound represented by the formula (1), $Q^{11}$ to $Q^{13}$ are preferably hydroxy groups. The inventors of the present invention speculate that in this case, both the ease of moisture penetration into the surface layer and the suppression of moisture reaching the lower layer can be achieved with good balance, thereby suppressing the environmental fluctuation.

In the compound represented by the formula (1), $R^{11}$ to $R^{13}$ are preferably alkylene groups having 1 or 2 carbon atoms. The inventors speculate that in this case, the steric hindrance is small and the water molecule and the isocyanuric ring skeleton are likely to form a hydrogen bond, thereby suppressing the environmental fluctuation.

The surface layer preferably further contains a polymer of a composition containing a compound having a chain-polymerizable functional group. The inventors speculate that in this case, the cross-linked structure of the polymer suppresses moisture reaching the lower layer, thereby suppressing the environmental fluctuation.

The composition preferably contains a compound represented by the following formula (2):

(2)

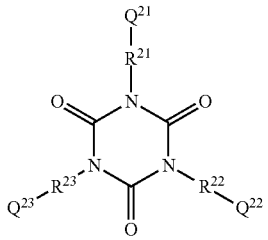

where, in the formula (2), $R^{21}$ to $R^{23}$ each independently represent an alkylene group having 1 to 6 carbon atoms, and $Q^{21}$ to $Q^{23}$ each independently represent an acryloyloxy group or a methacryloyloxy group.

It is speculated that in this case, the compound represented by the formula (1) becomes likely to be dispersed uniformly in the surface layer, which can suppress moisture reaching the lower layer, thereby suppressing the environmental fluctuation.

Specific examples of the compound represented by the formula (2) (exemplary compounds 2-1 to 2-6) are given below, but the present invention is not limited to these.

(2-1)

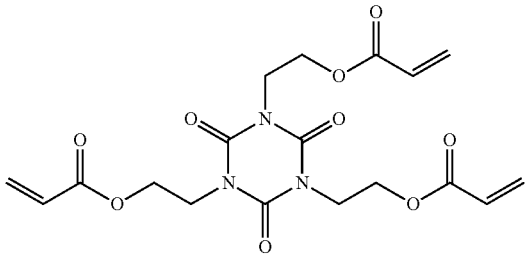

(2-2)

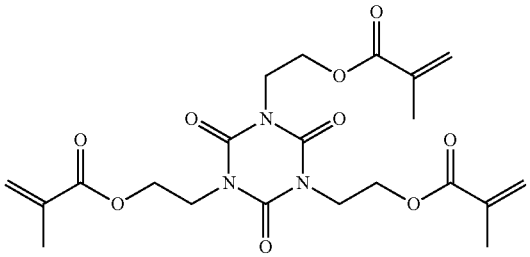

(2-3)

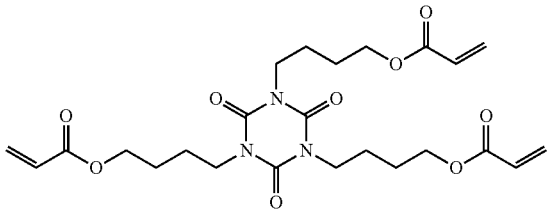

(2-4)

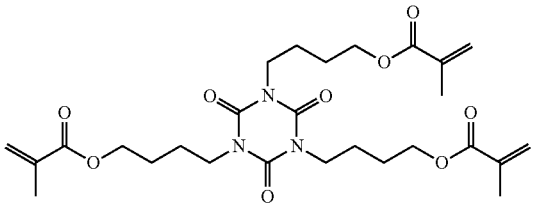

-continued (2-5)

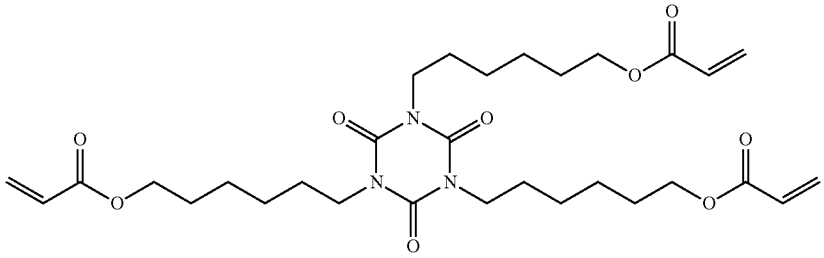

(2-6)

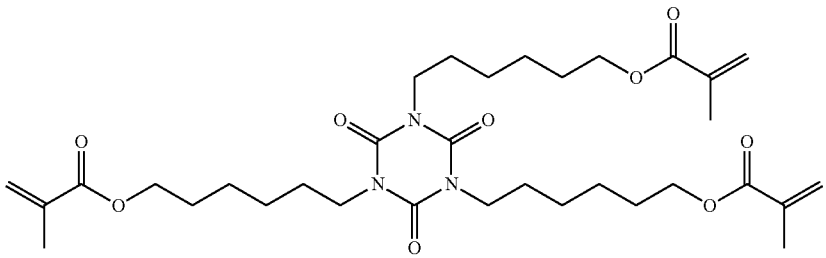

The composition preferably contains a compound represented by the following formula (CT-1) or (CT-2):

(CT-1)

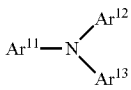

where, in the formula (CT-1), $Ar^{11}$ to $Ar^{13}$ each independently represent an aryl group which may be substituted by an alkyl group having 1 to 6 carbon atoms or a monovalent functional group represented by any of the following formulas (P-1) to (P-3), provided that the compound represented by the formula (CT-1) has at least one monovalent functional group represented by any of the following formulas (P-1) to (P-3);

(P-1)

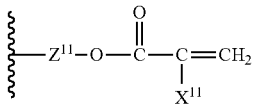

where, in the formula (P-1), $Z^{11}$ represents a single bond or an alkylene group having 1 to 6 carbon atoms, and $X^{11}$ represents a hydrogen atom or a methyl group;

(P-2)

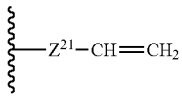

where, in the formula (P-2), $Z^{21}$ represents a single bond or an alkylene group having 1 to 6 carbon atoms;

(P-3)

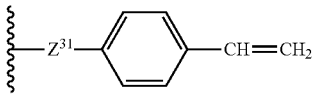

where, in the formula (P-3), $Z^{31}$ represents a single bond or an alkylene group having 1 to 6 carbon atoms;

(CT-2)

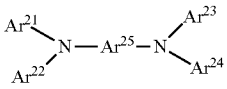

where, in the formula (CT-2), $Ar^{21}$ to $Ar^{24}$ each independently represent an aryl group which may be substituted by an alkyl group having 1 to 6 carbon atoms or a monovalent functional group represented by any of the following formulas (P-1) to (P-3), and $Ar^{25}$ represents an arylene group which may be substituted by an alkyl group having 1 to 6 carbon atoms or a monovalent functional group represented by any of the following formulas (P-1) to (P-3), provided that the compound represented by the formula (CT-2) has at least one monovalent functional group represented by any of the following formulas (P-1) to (P-3);

(P-1)

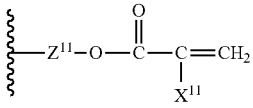

where, in the formula (P-1), $Z^{11}$ represents a single bond or an alkylene group having 1 to 6 carbon atoms, and $X^{11}$ represents a hydrogen atom or a methyl group;

(P-2)

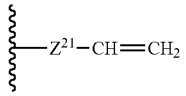

where, in the formula (P-2), $Z^{21}$ represents a single bond or an alkylene group having 1 to 6 carbon atoms;

(P-3)

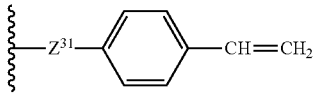

where, in the formula (P-3), $Z^{31}$ represents a single bond or an alkylene group having 1 to 6 carbon atoms.

The compound represented by the formula (CT-1) or (CT-2) has a triarylamine skeleton which is generally considered to have hole transportability. When the composition contains a compound represented by the formula (CT-1) or (CT-2), good electrical characteristics can be obtained because the compounds having a triarylamine skeleton are uniformly dispersed in the surface layer.

In the formula (CT-1), a substituted or unsubstituted aryl group is preferably any of a substituted or unsubstituted phenyl group, a substituted or unsubstituted biphenylyl group, or a substituted or unsubstituted fluorenyl group.

In the formula (CT-2), a substituted or unsubstituted arylene group is preferably any of a substituted or unsubstituted phenylene group, a substituted or unsubstituted biphenylylene group, or a substituted or unsubstituted fluorenylene group.

In the formulas (P-1) to (P-3), an alkylene group having 1 to 6 carbon atoms is preferably an ethylene group, a 1,3-propylene group, a 1,2-propylene group, or a 1,4-butylene group.

Specific examples of the compound represented by the formula (CT-1) (exemplary compounds CT1-1 to CT1-11) and specific examples of the compound represented by the formula (CT-2) (exemplary compounds CT2-1 to CT2-4) are given below, but the present invention is not limited to these.

(CT1-1)

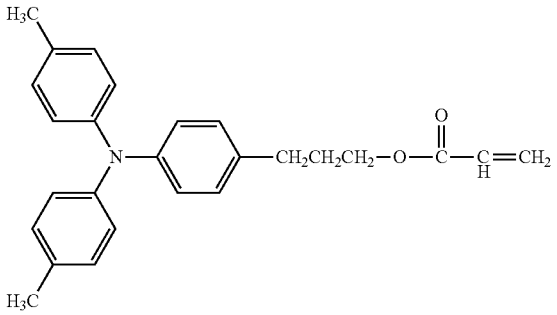

(CT1-2)

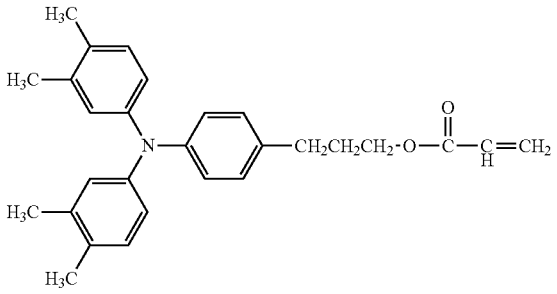

(CT1-3)

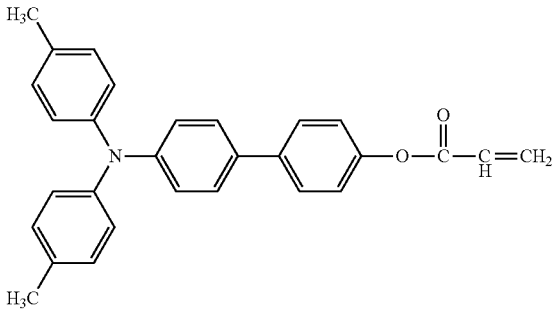

(CT1-4)

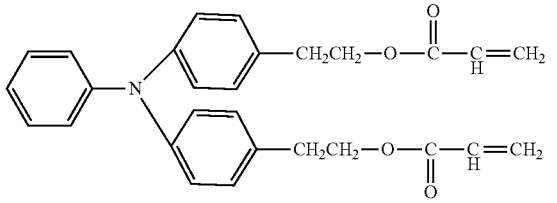

(CT1-5)

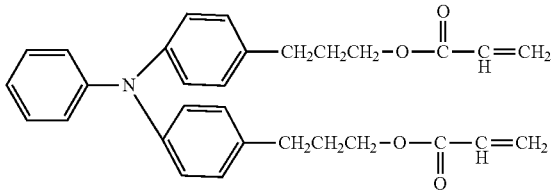

(CT1-6)

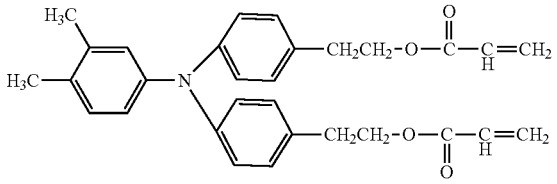

-continued
(CT1-7)
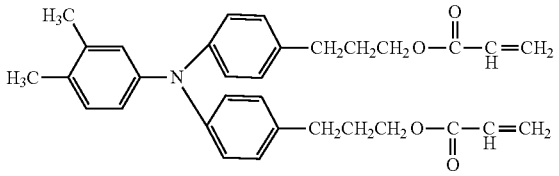
(CT1-8)
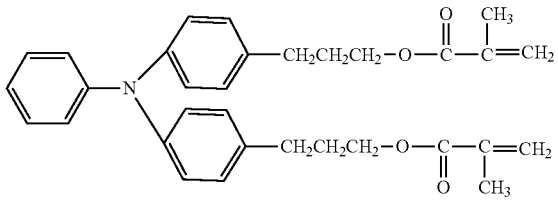
(CT1-9)
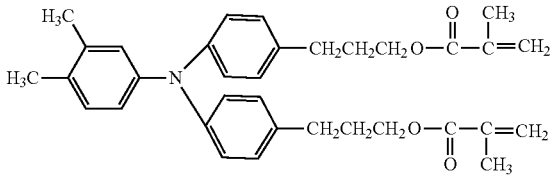
(CT1-10)
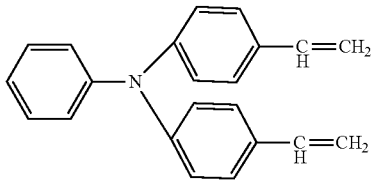
(CT1-11)
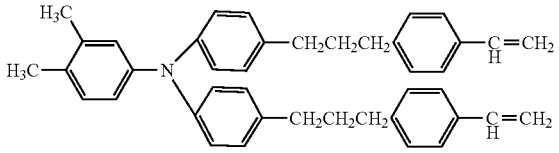
(CT2-1)
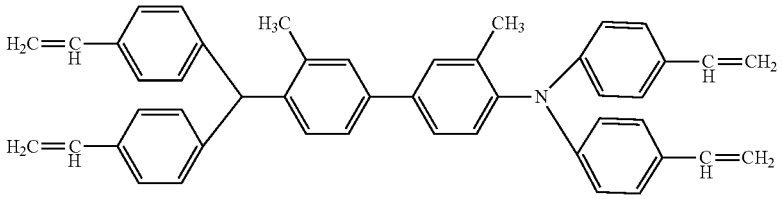
(CT2-2)
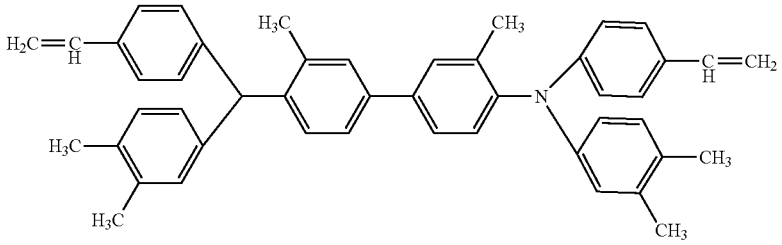
(CT2-3)
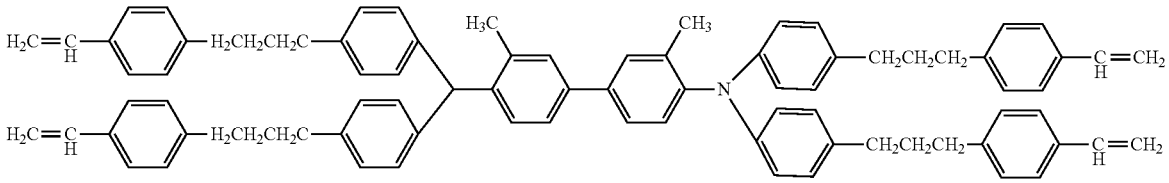
(CT2-4)
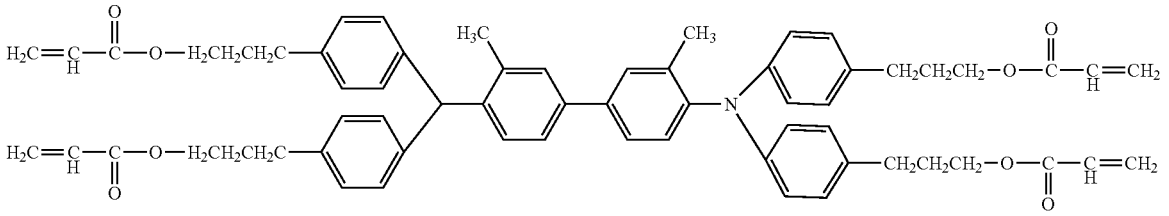

When the surface layer contains a polymer of a composition containing a compound represented by the formula (CT-1) or (CT-2), the content of the compound represented by the formula (CT-1) or (CT-2) is preferably 30% by mass or more based on the total mass of the composition.

When the surface layer contains a polymer of the compound represented by the formula (CT-1) or (CT-2), the content of the compound represented by the formula (1) in the surface layer is 0.015 to 1% by mass with respect to the content calculated before the polymerization. Within this range, good electrical characteristics can be provided. In addition, the composition may contain the compound represented by the formula (1), in which case the content of the compound represented by the formula (1) in the composition is preferably 0.015 to 1% by mass with respect to the content of the compound represented by the formula (CT-1) or (CT-2) in the composition.

Next, the configuration of an electrophotographic photosensitive member of the present invention will be described. In addition, each configuration of the electrophotographic photosensitive member will be explained, and its manufacturing method will be also explained.

[Electrophotographic Photosensitive Member]

An electrophotographic photosensitive member according to one aspect of the present invention has a support and a surface layer.

Figure 2:
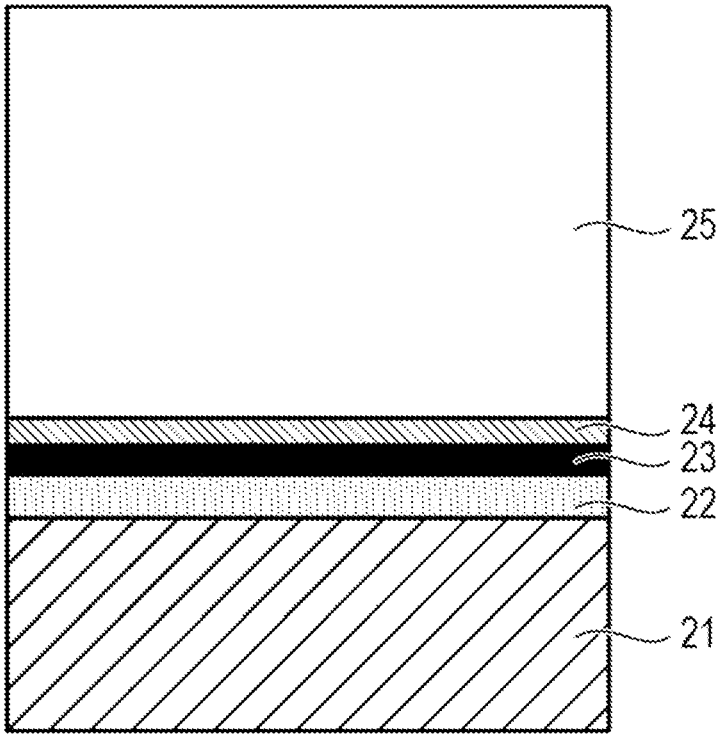
FIG. 2 is a view for illustrating an example of the layer configuration of an electrophotographic photosensitive member of the present invention.

FIG. 2 is a view for illustrating an example of the layer configuration of the electrophotographic photosensitive member. In FIG. 2, the electrophotographic photosensitive member has a support 21, an undercoat layer 22, a charge generating layer 23, a charge transporting layer 24, and a protection layer 25. In this case, the charge generating layer 23 and the charge transporting layer 24 configure a photosensitive layer.

Examples of the method for manufacturing the electrophotographic photosensitive member include the method in which coating liquids for each layer which will be described later are prepared, coated in the desired order of the layers, and dried. The methods for coating them include dip coating, spray coating, ink jet coating, roll coating, die coating, blade coating, curtain coating, wire bar coating, and ring coating. Among these, dip coating is preferable from the viewpoint of efficiency and productivity.

The support and each layer are described below.

<Support>

The electrophotographic photosensitive member of the present invention has a support, and the support preferably has electroconductivity. Examples of the shape of the support include a cylindrical shape, a belt shape, and a sheet shape. Of those, a cylindrical support is preferred. In addition, the surface of the support may be subjected to electrochemical treatment such as anodization, blast treatment, cutting treatment and the like.

A metal, a resin, glass, and the like are preferred as a material for the support. Examples of the metal include aluminum, iron, nickel, copper, gold, stainless steel, and alloys thereof. Of those, an aluminum support using aluminum is preferred.

In addition, it is preferable to impart electroconductivity to the resin or glass through treatment involving, for example, mixing or coating the resin or the glass with a conductive material.

<Electroconductive Layer>

In the present invention, an electroconductive layer may be provided on the support. By providing the electroconductive layer, flaws and irregularities in the surface of the support can be concealed, and the reflection of light on the surface of the support can be controlled. The electroconductive layer preferably contains electroconductive particles and a resin.

Examples of the material for the electroconductive particles include a metal oxide, a metal and carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the electroconductive particles, and in particular, titanium oxide, tin oxide, and zinc oxide are more preferably used.

When the metal oxide is used as the electroconductive particles, the surface of the metal oxide may be treated with a silane coupling agent and the like, or the metal oxide may be doped with an element, such as phosphorus, aluminum and an oxide thereof.

In addition, each of the electroconductive particles may be of a laminated structure having a core particle and a coating layer coating the particle. Examples of the core particle include titanium oxide, barium sulfate, and zinc oxide. Examples of the coating layer include a metal oxide, such as tin oxide.

Moreover, when the metal oxide is used as the electroconductive particles, their volume-average particle diameter is preferably 1 to 500 nm, more preferably 3 to 400 nm.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the electroconductive layer may further contain a concealing agent, such as a silicone oil, resin particles, and titanium oxide.

The average film thickness of the electroconductive layer is preferably 1 to 50 μm, particularly preferably 3 to 40 μm.

The electroconductive layer may be formed by preparing a coating liquid for an electroconductive layer containing the above-mentioned materials and a solvent, forming a coating film thereof, and drying the coating film. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. Examples of the dispersion method for dispersing the electroconductive particles in the coating liquid for an electroconductive layer include methods using a paint shaker, a sand mill, a ball mill, and a liquid collision-type high-speed disperser.

<Undercoat Layer>

In the present invention, an undercoat layer may be provided on the support or the electroconductive layer. By providing the undercoat layer, an adhesive function between the layers is improved and a charge injection-inhibiting function can be imparted.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a group containing a carboxylic acid anhydride structure, and a carbon-carbon double bond group.

In addition, the undercoat layer may further contain an electron transporting substance, a metal oxide, a metal, an electroconductive polymer, and the like for the purpose of improving electrical characteristics. Of those, an electron transporting substance and a metal oxide are preferably used.

Examples of the electron transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transporting substance having a polymerizable functional group may be used as the electron transporting substance and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average film thickness of the undercoat layer is preferably 0.1 to 50 μm, more preferably 0.2 to 40 μm, and particularly preferably 0.3 to 30 μm.

The undercoat layer may be formed by preparing a coating liquid for an undercoat layer containing the above-mentioned materials and a solvent, forming a coating film thereof, and drying and/or curing the coating film. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of the electrophotographic photosensitive member are mainly classified into (1) a laminate type photosensitive layer and (2) a single layer type photosensitive layer. (1) The laminate type photosensitive layer has a charge generating layer containing a charge generating substance and a charge transporting layer containing a charge transporting substance. (2) The single layer type photosensitive layer is a photosensitive layer containing a charge generating substance and a charge transporting substance together.

(1) Laminate Type Photosensitive Layer

The laminate type photosensitive layer includes a charge generating layer and a charge transporting layer. When no protective layer is provided on the laminate type photosensitive layer, the charge transporting layer becomes the surface layer.

(1-1) Charge Generating Layer

The charge generating layer preferably contains a charge generating substance and a resin.

Examples of the charge generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge generating substance in the charge generating layer is preferably 40 to 85% by mass, more preferably 60 to 80% by mass with respect to the total mass of the charge generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is preferred.

In addition, the charge generating layer may further contain an additive, such as an antioxidant and a UV absorber. Specific examples thereof include a hindered phenol compound, a hindered amine compound, a sulfur compound, a phosphorus compound, and a benzophenone compound.

The average film thickness of the charge generating layer is preferably 0.1 to 1 μm, more preferably 0.15 to 0.4 μm.

The charge generating layer may be formed by preparing a coating liquid for a charge generating layer containing the above-mentioned materials and a solvent, forming a coating film thereof, and drying the coating film. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge Transporting Layer

The charge transporting layer preferably contains a charge transporting substance and a resin.

Examples of the charge transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge transporting substance in the charge transporting layer is preferably 25 to 70% by mass, more preferably 30 to 55% by mass with respect to the total mass of the charge transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) of the charge transporting substance to the resin is preferably 4:10 to 20:10, more preferably 5:10 to 12:10.

In addition, the charge transporting layer may contain an additive, such as an antioxidant, a UV absorber, a plasticizer, a leveling agent, a lubricity-imparting agent, and an abrasion resistance improver. Specific examples of the additive include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average film thickness of the charge transporting layer is preferably 5 to 50 μm, more preferably 8 to 40 μm, particularly preferably 10 to 30 μm.

The charge transporting layer may be formed by preparing a coating liquid for a charge transporting layer containing the above-mentioned materials and a solvent, forming a coating film thereof, and drying the coating film. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent and an aromatic hydrocarbon-based solvent are preferred.

(2) Single Layer Type Photosensitive Layer

The single layer type photosensitive layer may be formed by preparing a coating liquid for a photosensitive layer containing a charge generating substance, a charge transporting substance, a resin, and a solvent, forming a coating film thereof, and drying the coating film. Examples of the charge generating substance, the charge transporting substance, and the resin are the same as those of the examples of the materials in the section "(1) Laminate Type Photosensitive Layer".

The average film thickness of the single layer type photosensitive layer is preferably 5 to 50 μm, more preferably 8 to 40 μm, and particularly preferably 10 to 30 μm.

When no protection layer is provided on the single layer type photosensitive layer, the single layer type photosensitive layer becomes the surface layer.

<Protection Layer>

In the present invention, a protection layer may be provided on the photosensitive layer. By providing the protection layer, durability can be improved. If the protection layer is provided on the photosensitive layer, the protection layer becomes the surface layer.

The protection layer preferably contains a charge transporting substance.

Examples of the charge transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

In addition, the protection layer is preferably formed as a cured film by polymerizing a composition containing a monomer having a polymerizable functional group. As a reaction in this case, there are given, for example, a thermal polymerization reaction, a photopolymerization reaction, and a radiation polymerization reaction. Examples of the polymerizable functional group of the monomer having a polymerizable functional group include an acryloyloxy group and a methacryloyloxy group. A material having a charge transporting ability may be used as the monomer having a polymerizable functional group.

The protection layer may contain an additive, such as an antioxidant, a UV absorber, a plasticizer, a leveling agent, a lubricity-imparting agent, and an abrasion resistance improver. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average film thickness of the protection layer is preferably 0.5 to 10 μm, and more preferably 1 to 7 μm.

The protection layer may be formed by preparing a coating liquid for a protection layer containing the above-mentioned materials and a solvent, forming a coating film thereof, and drying and/or curing the coating film. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

Examples of the method of curing the coating film of the coating liquid for a protection layer include curing by heat, ultraviolet rays, or electron beams. In order to maintain the strength of the protection layer (i.e., the surface layer) and the durability of the electrophotographic photosensitive member, it is preferable to cure the coating film using ultraviolet rays or electron beams.

When the coating film is polymerized by using electron beams, since a very dense (high density) cured material (three-dimensionally crosslinked structure) can be obtained and the protection layer having higher durability can be obtained, the case is preferable. Examples of an accelerator in the case of irradiation with electron beams include scanning-type, electrocurtain-type, broad beam-type, pulse-type and laminar-type ones.

In the case of using electron beams, the acceleration voltage of the electron beams is preferably 120 kV or lower from the viewpoint of being capable of suppressing deterioration of material characteristics by electron beams without impairing the polymerization efficiency. In addition, the electron beam-absorbed dose by the surface of the coating film of the coating liquid for a protection layer is preferably 1 to 50 kGy, and more preferably 5 to 10 kGy.

In addition, in the case of curing (polymerizing) the coating film by using electron beams, it is preferable that the coating film be irradiated with electron beams in an inert gas atmosphere, and thereafter heated in an inert gas atmosphere for the purpose of suppressing the polymerization inhibitory action by oxygen. Examples of the inert gas include nitrogen, argon and helium.

Moreover, it is preferable that after the irradiation with ultraviolet rays or electron beams, the electrophotographic photosensitive member be heated at 100 to 170° C. By doing so, the protection layer which has higher durability and suppresses image defects can be obtained.

<Surface Layer>

In the present invention, the surface layer is a layer provided on the outermost surface of the electrophotographic photosensitive member.

In the electrophotographic photosensitive member having a protection layer, the protection layer is the surface layer. In the electrophotographic photosensitive member without a protection layer, the charge transporting layer is the surface layer when the photosensitive layer is a laminate type photosensitive layer, and the photosensitive layer is the surface layer when the photosensitive layer is a single layer type photosensitive layer.

When the surface layer is a protection layer, the photosensitive layer is a laminate type photosensitive layer, and the surface layer is preferably a protection layer provided on the charge transporting layer.

[Process Cartridge and Electrophotographic Apparatus]

A process cartridge according to the present invention includes an electrophotographic photosensitive member of the present invention and at least one unit selected from the group consisting of a charging unit, a developing unit, a transfer unit, and a cleaning unit, the process cartridge integrally supporting the electrophotographic photosensitive member and the at least one unit, and being detachably attachable to a main body of an electrophotographic apparatus.

In addition, an electrophotographic apparatus according to the present invention has an electrophotographic photosensitive member according to the present invention and a charging unit, an exposing unit, a developing unit and a transfer unit.

An example of the schematic configuration of an electrophotographic apparatus equipped with a process cartridge having an electrophotographic photosensitive member is illustrated in FIG. 1.

A cylindrical electrophotographic photosensitive member 1 is rotationally driven about a shaft 2 in a direction indicated by the arrow at a predetermined peripheral speed. The surface of the electrophotographic photosensitive member 1 is charged to a predetermined positive or negative potential by a charging unit 3. In FIG. 1, a roller charging system based on a roller-type charging member is illustrated, but a charging system such as a corona charging system, a proximity charging system, and an injection charging system may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit 5 and the like without separate arrangement of the cleaning unit 9 may be used. The electrophotographic apparatus may include an electricity-removing mechanism configured to subject the surface of the electrophotographic photosensitive member 1 to electricity-removing treatment with pre-exposure light 10 from a pre-exposing unit (not shown). In addition, a guiding unit 12, such as a rail, may be provided to detach and attach a process cartridge 11 according to the present invention onto and from the main body of the electrophotographic apparatus.

The electrophotographic photosensitive member according to the present invention can be used in, for example, a laser beam printer, an LED printer, a copying machine, a facsimile, and a multifunctional peripheral thereof.

According to the present invention, an electrophotographic photosensitive member capable of suppressing the difference in the electrical characteristics caused by the differences in the use environment (environmental fluctuation) can be provided. Furthermore, according to the present invention, a process cartridge and an electrophotographic apparatus having the electrophotographic photosensitive member can be provided.

EXAMPLES

The present invention is described in more detail with reference to Examples and Comparative Examples below, but the present invention is not limited in any way by the following Examples as long as the gist thereof is not exceeded. "Part" is on a mass basis unless otherwise indicated in the following Examples.

Example 1

An aluminum cylinder having a diameter of 30 mm, a length of 357.5 mm, and a thickness of 1 mm was used as a support (an electroconductive support).

Next, 100 parts of zinc oxide particles (specific surface area: 19 $m^2/g$, powder resistivity: $4.7\times10^6$ Ω·cm) were mixed with 500 parts of toluene under stirring. To the mixture, 0.8 part of a silane coupling agent was added and the whole was stirred for 6 hours. After that, toluene was distilled under reduced pressure, and the residue was dried by heating at 130° C. for 6 hours to provide surface-treated zinc oxide particles. As the silane coupling agent, KBM602 (compound name: N-2-(aminoethyl)-3-aminopropylmethyldimethoxysilane), manufactured by Shin-Etsu Chemical Co., Ltd. was used.

Then, 15 parts of polyvinyl butyral resin (product name: BM-1, manufactured by Sekisui Chemical Co., Ltd., weight-average molecular weight: 40,000) as a polyol resin and 15 parts of a blocked isocyanate (product name: Sumidur 3175, manufactured by Sumika Covestro Urethane Co., Ltd.) were dissolved in a mixed solution of 73.5 parts of methyl ethyl ketone and 73.5 parts of 1-butanol. To the resultant solution, 80.8 parts of the surface-treated zinc oxide particles described above and 0.8 part of 2,3,4-trihydroxybenzophenone (manufactured by Tokyo Chemical Industry Co., Ltd.) were added, and the mixture was dispersed under an atmosphere at 23±3° C. for 3 hours with a sand mill apparatus using glass beads each having a diameter of 0.8 mm. After the dispersion, 0.01 part of a silicone oil (product name: SH28PA, manufactured by Toray Dow Corning Co., Ltd.) and 5.6 parts of crosslinked polymethyl methacrylate (PMMA) particles (product name: TECHPOLYMER SSX-103, manufactured by Sekisui Kasei Co., Ltd., average primary particle diameter: 3 μm) were added, and the whole was stirred to prepare a coating liquid for an undercoat layer.

The coating liquid for an undercoat layer was applied onto the above-mentioned aluminum cylinder by dip coating to form a coating film, and the obtained coating film was dried at 160° C. for 40 minutes to form an undercoat layer having a film thickness of 18 μm.

Next, Hydroxygallium phthalocyanine crystal of a crystal form having strong peaks at 7.4° and 28.2° of Bragg angle 2θ±0.2° in CuKα characteristic X-ray diffraction was prepared. Twenty parts of the Hydroxygallium phthalocyanine crystal, 0.2 part of a compound represented by the following formula (A), 10 parts of a polyvinyl butyral resin (product name: S-LEC BX-1, manufactured by Sekisui Chemical Co., Ltd.) and 600 parts of a cyclohexanone were dispersed with a sand mill apparatus using glass beads each having a diameter of 1 mm for 4 hours, and then 700 parts of ethyl acetate was added to prepare a coating liquid for a charge generating layer. The coating liquid for a charge generating layer was applied onto the undercoat layer by dip coating to form a coating film, and the obtained coating film was dried by heating in an oven at the temperature of 80° C. for 15 minutes to form a charge generating layer having a film thickness of 0.17 μm.

(A)

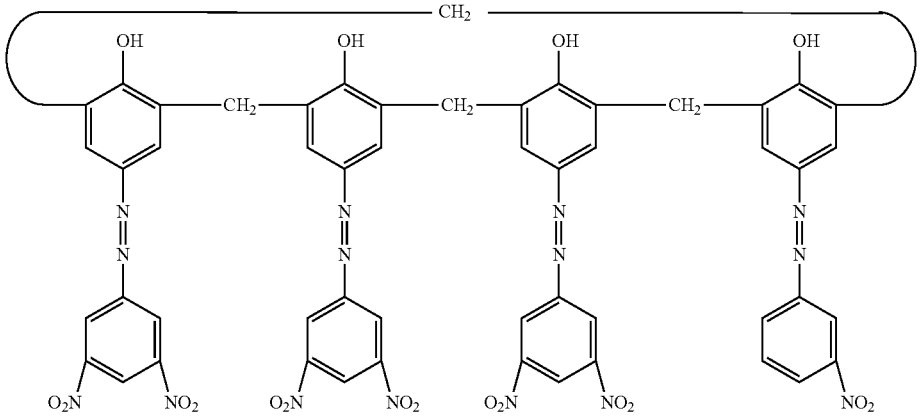

Then, 30 parts of a compound represented by the following formula (B) (charge transporting substance), 60 parts of a compound represented by the following formula (C) (charge transporting substance), 10 parts of a compound represented by the following formula (D), 100 parts of a polycarbonate resin (product name: Iupilon Z400, manufactured by Mitsubishi Engineering-Plastics Corporation, bisphenol Z-type), 0.02 part of a polycarbonate having a structural unit represented by the following formula (E) (viscosity average molecular weight Mv: 40,000) and 0.2 part of a compound represented by the following formula (1) (exemplary compound 1-3) were dissolved in a solvent of 600 parts of mixed xylene and 200 parts of dimethoxymethane to prepare a coating liquid 1 for a charge transporting layer:

(B)

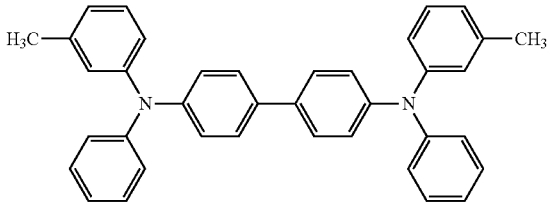

(C)

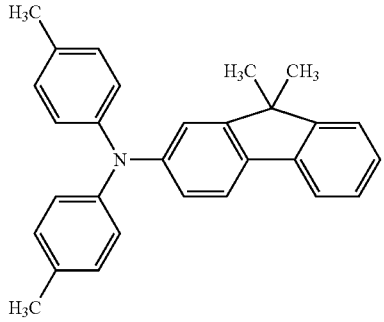

(D)

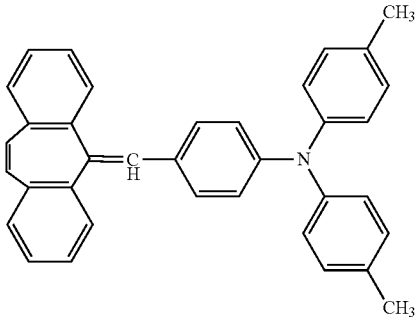

(E)

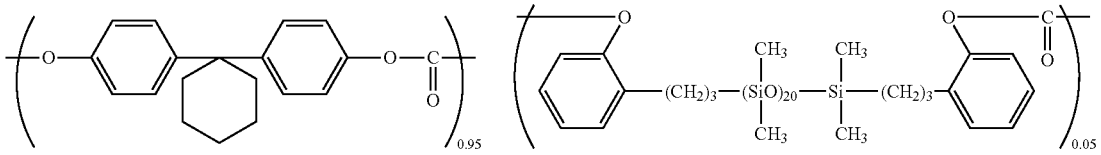

where, in the formula (E), 0.95 and 0.05 are the molar ratio (copolymerization ratio) of the 2 structural units.

The coating liquid 1 for a charge transporting layer was applied onto the charge generating layer by dip coating to form a coating film, and the obtained coating film was dried at 100° C. for 30 minutes, to form a charge transporting layer (the surface layer) having a film thickness of 18 Thus, an electrophotographic photosensitive member E1 was manufactured.

Example 2

An electrophotographic photosensitive member E2 was manufactured in the same manner as Example 1 except that the exemplary compound 1-3 contained in the coating liquid for a charge transporting layer was changed to the exemplary compound 1-7.

Example 3

An electrophotographic photosensitive member E3 was manufactured in the same manner as Example 1 except that the exemplary compound 1-3 contained in the coating liquid for a charge transporting layer was changed to the exemplary compound 1-8.

Example 4

An electrophotographic photosensitive member E4 was manufactured in the same manner as in Example 3, except that the amount of the exemplary compound 1-8 contained in the coating liquid for a charge transporting layer was changed from 0.2 part to 1 part.

Example 5

An electrophotographic photosensitive member E5 was manufactured in the same manner as in Example 3, except that the amount of the exemplary compound 1-8 contained in the coating liquid for a charge transporting layer was changed from 0.2 part to 2 parts.

Example 6

An electrophotographic photosensitive member E6 was manufactured in the same manner as in Example 3, except that the amount of the exemplary compound 1-8 contained in the coating liquid for a charge transporting layer was changed from 0.2 part to 4 parts.

Example 7

An electrophotographic photosensitive member E7 was manufactured in the same manner as in Example 3, except that the amount of the exemplary compound 1-8 contained in the coating liquid for a charge transporting layer was changed from 0.2 part to 0.02 part.

Example 8

An electrophotographic photosensitive member E8 was manufactured in the same manner as in Example 3, except that the amount of the exemplary compound 1-8 contained in the coating liquid for a charge transporting layer was changed from 0.2 part to 0.01 part.

Example 9

The process up to the formation of a charge generating layer was performed in the same manner as in Example 1.

Next, 30 parts of a compound represented by the formula (B) (charge transporting substance), 60 parts of a compound represented by the formula (C) (charge transporting substance), 10 parts of a compound represented by the formula (D), 100 parts of a polycarbonate resin (product name: Iupilon Z400, manufactured by Mitsubishi Engineering-Plastics Corporation, bisphenol Z-type) and 0.02 part of a polycarbonate having a structural unit represented by the formula (E) (viscosity average molecular weight Mv: 20,000) were dissolved in a solvent of 600 parts of mixed xylene and 200 parts of dimethoxymethane to prepare a coating liquid 2 for a charge transporting layer.

The coating liquid 2 for a charge transporting layer was applied onto the charge generating layer by dip coating to form a coating film, and the obtained coating film was dried at 100° C. for 30 minutes, to form a charge transporting layer having a film thickness of 18 μm.

Then, 0.1 part of a compound represented by the formula (1) (exemplary compound 1-3), 50 parts of a compound represented by the formula (2) (exemplary compound 2-1) and 50 parts of a compound represented by the formula (B) (charge transporting substance) were dissolved in 75 parts of 2-propanol and 75 parts of tetrahydrofuran to prepare a coating liquid 1 for a protection layer.

The coating liquid 1 for a protection layer was applied onto the charge transporting layer by dip coating to form a coating film, and the obtained coating film was dried at 50° C. for 5 minutes. Next, under a nitrogen atmosphere, under the conditions of an acceleration voltage of 70 kV and a beam current of 5.0 mA, while the support (object to be irradiated) was rotated at a speed of 200 rpm, the coating film was irradiated with electron beams for 1.5 seconds, and then the temperature of the coating film was raised for 10 seconds from 25° C. to 120° C. to cure the coating film. The absorbed dose of the electron beams at this time was 15 kGy, and the oxygen concentration from the irradiation with the electron beams to the subsequent heat treatment was 20 ppm or less. Then, the coating film was naturally cooled to a temperature of 25° C. in the air, and then heated at 100° C. for 15 minutes to form a protection layer (surface layer) with a film thickness of 5 μm. Thus, an electrophotographic photosensitive member E9 was manufactured.

Example 10

An electrophotographic photosensitive member E10 was manufactured in the same manner as Example 9 except that the exemplary compound 2-1 contained in the coating liquid for a protection layer was changed to the compound represented by the following formula (G).

(G)

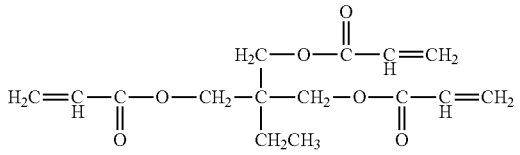

Example 11

An electrophotographic photosensitive member E11 was manufactured in the same manner as Example 9 except that the exemplary compound 2-1 contained in the coating liquid for a protection layer was changed to the compound represented by the formula (G) and the compound represented by the formula (B) was changed to the compound represented by the formula (CT-1) (exemplary compound CT1-3).

Example 12

An electrophotographic photosensitive member E12 was manufactured in the same manner as Example 9 except that the exemplary compound 2-1 contained in the coating liquid for a protection layer was changed to the compound represented by the formula (H) and the compound represented by the formula (B) was changed to the compound represented by the formula (CT-1) (exemplary compound CT1-5).

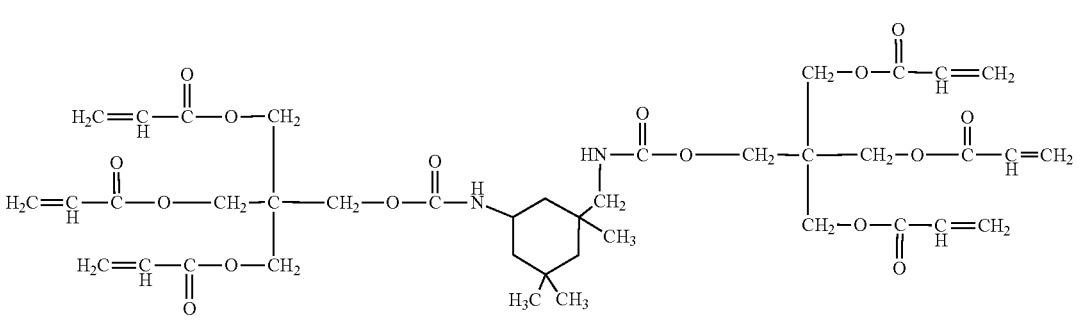

Example 13

The process up to the formation of a charge transporting layer was performed in the same manner as in Example 9.

Next, 0.1 part of the compound represented by the formula (1) (exemplary compound 1-3), 20 Parts of the compound represented by the formula (2) (exemplary compound 2-1), 50 Parts of the compound represented by the formula (CT-1) (exemplary compound CT1-5), 30 parts of polytetrafluoroethylene particles (Lubron L-2, manufactured by Daikin Industries, Ltd.), 2 parts of a fluorine atom-containing acrylic resin having a repeating structural unit represented by the following formula (F1) and a repeating structural unit represented by the following formula (F2) (weight-average molecular weight: 83,000, copolymerization ratio (F1)/(F2)=1/1 (molar ratio)), 75 parts of 1-propanol and 75 parts of 1,1,2,2,3,3,4-heptafluorocyclopentane (product name: ZEORORA H, manufactured by Zeon Corporation) were mixed, and then the resultant solution was dispersed by an ultra-high speed disperser. After that, the solution was filtered through a polyflon filter (trade name: PF-060, manufactured by Advantec Toyo Kaisha, Ltd.) to provide a coating liquid 2 for a protection layer.

(F1)

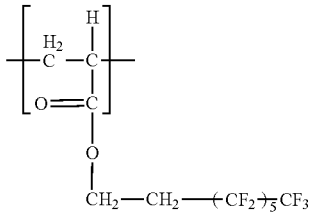

(H)

-continued (F2)

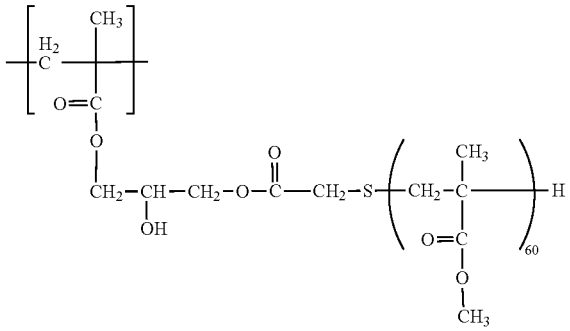

The coating liquid 2 for a protection layer was applied onto the charge transporting layer by dip coating to form a coating film, and the obtained coating film was dried at 50° C. for 5 minutes. Next, under a nitrogen atmosphere, under the conditions of an acceleration voltage of 70 kV and a beam current of 5.0 mA, while the support (object to be irradiated) was rotated at a speed of 200 rpm, the coating film was irradiated with electron beams for 1.5 seconds, and then the temperature of the coating film was raised for 10 seconds from 25° C. to 120° C. to cure the coating film. The absorbed dose of the electron beams at this time was 15 kGy, and the oxygen concentration from the irradiation with the electron beams to the subsequent heat treatment was 20 ppm or less. Then, the coating film was naturally cooled to a temperature of 25° C. in the air, and then heated at 100° C.

for 15 minutes to form a protection layer (surface layer) with a film thickness of 5 μm. Thus, an electrophotographic photosensitive member E13 was manufactured.

Example 14

An electrophotographic photosensitive member E14 was manufactured in the same manner as Example 13 except that the exemplary compound CT1-5 contained in the coating liquid for a protection layer was changed to the exemplary compound CT1-7.

Example 15

An electrophotographic photosensitive member E15 was manufactured in the same manner as Example 14 except that the exemplary compound 1-3 contained in the coating liquid for a protection layer was changed to the exemplary compound 1-7.

Example 16

An electrophotographic photosensitive member E16 was manufactured in the same manner as Example 14 except that the exemplary compound 1-3 contained in the coating liquid for a protection layer was changed to the exemplary compound 1-9.

Example 17

An electrophotographic photosensitive member E17 was manufactured in the same manner as Example 14 except that the exemplary compound 1-3 contained in the coating liquid for a protection layer was changed to the exemplary compound 1-4.

Example 18

An electrophotographic photosensitive member E18 was manufactured in the same manner as in Example 14, except that the amount of the exemplary compound 1-3 contained in the coating liquid for a protection layer was changed from 0.1 part to 0.5 part.

Example 19

An electrophotographic photosensitive member E19 was manufactured in the same manner as in Example 14, except that the amount of the exemplary compound 1-3 contained in the coating liquid for a protection layer was changed from 0.1 part to 1 part.

Example 20

An electrophotographic photosensitive member E20 was manufactured in the same manner as in Example 14, except that the amount of the exemplary compound 1-3 contained in the coating liquid for a protection layer was changed from 0.1 part to 2 parts.

Example 21

An electrophotographic photosensitive member E21 was manufactured in the same manner as in Example 14, except that the amount of the exemplary compound 1-3 contained in the coating liquid 2 for a protection layer was changed from 0.1 part to 0.01 part.

Example 22

An electrophotographic photosensitive member E22 was manufactured in the same manner as in Example 14, except that the amount of the exemplary compound 1-3 contained in the coating liquid 2 for a protection layer was changed from 0.1 part to 0.05 part.

Comparative Example 1

An electrophotographic photosensitive member C1 was manufactured in the same manner as in Example 1, except that the compound represented by the formula (1) (exemplary compound 1-3) was not used.

Comparative Example 2

An electrophotographic photosensitive member C2 was manufactured in the same manner as in Example 13, except that the compound represented by the formula (1) (exemplary compound 1-3) was not used.

Comparative Example 3

An electrophotographic photosensitive member C3 was manufactured in the same manner as Example 13 except that the compound represented by the formula (1) (exemplary compound 1-3) was changed to the compound represented by the following formula (1).

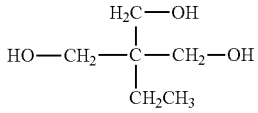

(I)

[Evaluation]

<Evaluation of Electrical Characteristics>

The electrophotographic photosensitive members manufactured in each Example and Comparative Example were attached to the cyan station of a modified machine of an electrophotographic apparatus (copying machine) (product name: iR-ADV C5255, manufactured by Canon Inc.) as an evaluation apparatus, and the evaluation was performed under the following conditions. A surface potential of the electrophotographic photosensitive member was measured by pulling out a cartridge for development from the evaluation apparatus, and fixing a potential probe (product name: model 6000B-8, manufactured by Trek Corporation) thereon, by using a surface potential meter (model 344: manufactured by Trek Corporation). First, the dark part potential (VD) of the electrophotographic photosensitive member to be used for the evaluation was adjusted to −750V. Next, the bright part potential (VL) of the surface of the electrophotographic photosensitive member was evaluated under constant exposure light volume conditions of the exposing unit. The evaluation was carried out in a low temperature and low humidity environment of 15° C. and 10% RH and a high temperature and high humidity environment of 30° C. and 80% RH, respectively. VL in the evaluation under the low temperature and low humidity environment was set to VL (LL), and VL in the evaluation in the high temperature and high humidity environment was set to VL (HH).

In the present invention, when VL (LL) and VL (HH) are less than 250 V respectively, it was determined that there was no problem in the characteristics of the electrophotographic photosensitive member.

<Evaluation of Environmental Fluctuation>

The value of "VL (HH)−VL (LL)" was calculated as a result of the environmental fluctuation.

In the present invention, if the environmental fluctuation (VL (HH)−VL (LL)) was less than 40 V, it was determined that there was no problem in the characteristics of the electrophotographic photosensitive member.

The evaluation results of Examples 1 to 22 and Comparative Examples 1 to 3 are shown in Table 1.

TABLE 1

| | Compound represented by formula (1) | Compound represented by formula (2) | Compound represented by formula (CT-1) or formula (CT-2) | Mass content of compound represented by formula (1) with respect to total mass of surface layer | Electrical characteristics (V) | | Environmental fluctuation (V) |
|---|---|---|---|---|---|---|---|
| | | | | | VL(LL) | VL(HH) | VL(HH) − VL(LL) |
| Example 1 | Exemplary compound 1-3 | — | — | 0.1% by mass | 201 | 213 | 12 |
| Example 2 | Exemplary compound 1-7 | — | — | 0.1% by mass | 200 | 216 | 16 |
| Example 3 | Exemplary compound 1-8 | — | — | 0.1% by mass | 199 | 220 | 21 |
| Example 4 | Exemplary compound 1-8 | — | — | 0.5% by mass | 201 | 223 | 22 |
| Example 5 | Exemplary compound 1-8 | — | — | 1% by mass | 199 | 223 | 24 |
| Example 6 | Exemplary compound 1-8 | — | — | 2% by mass | 201 | 226 | 25 |
| Example 7 | Exemplary compound 1-8 | — | — | 0.01% by mass | 199 | 222 | 23 |
| Example 8 | Exemplary compound 1-8 | — | — | 0.005% by mass | 198 | 225 | 27 |
| Example 9 | Exemplary compound 1-3 | Exemplary compound 2-1 | — | 0.1% by mass | 194 | 197 | 3 |
| Example 10 | Exemplary compound 1-3 | — | — | 0.1% by mass | 195 | 203 | 8 |
| Example 11 | Exemplary compound 1-3 | — | Exemplary compound CT1-3 | 0.1% by mass | 191 | 201 | 10 |
| Example 12 | Exemplary compound 1-3 | — | Exemplary compound CT1-5 | 0.1% by mass | 192 | 203 | 11 |
| Example 13 | Exemplary compound 1-3 | Exemplary compound 2-1 | Exemplary compound CT1-5 | 0.1% by mass | 184 | 186 | 2 |
| Example 14 | Exemplary compound 1-3 | Exemplary compound 2-1 | Exemplary compound CT1-7 | 0.1% by mass | 186 | 189 | 3 |
| Example 15 | Exemplary compound 1-7 | Exemplary compound 2-1 | Exemplary compound CT1-7 | 0.1% by mass | 185 | 192 | 7 |
| Example 16 | Exemplary compound 1-9 | Exemplary compound 2-1 | Exemplary compound CT1-7 | 0.1% by mass | 186 | 194 | 8 |
| Example 17 | Exemplary compound 1-4 | Exemplary compound 2-1 | Exemplary compound CT1-7 | 0.1% by mass | 185 | 191 | 6 |
| Example 18 | Exemplary compound 1-3 | Exemplary compound 2-1 | Exemplary compound CT1-7 | 0.5% by mass | 190 | 194 | 4 |
| Example 19 | Exemplary compound 1-3 | Exemplary compound 2-1 | Exemplary compound CT1-7 | 1% by mass | 195 | 202 | 7 |
| Example 20 | Exemplary compound 1-3 | Exemplary compound 2-1 | Exemplary compound CT1-7 | 2% by mass | 202 | 211 | 9 |
| Example 21 | Exemplary compound 1-3 | Exemplary compound 2-1 | Exemplary compound CT1-7 | 0.01% by mass | 184 | 189 | 5 |
| Example 22 | Exemplary compound 1-3 | Exemplary compound 2-1 | Exemplary compound CT1-7 | 0.005% by mass | 184 | 196 | 12 |
| Comparative Example 1 | None | — | — | — | 202 | 264 | 62 |
| Comparative Example 2 | None | Exemplary compound 2-1 | Exemplary compound CT1-5 | — | 185 | 237 | 52 |
| Comparative Example 3 | (I) | Exemplary compound 2-1 | Exemplary compound CT1-5 | 0.1% by mass | 191 | 239 | 48 |

As a result of the evaluation, in Examples, the environmental fluctuation was sufficiently suppressed and there was no problem. In Comparative Examples, there was a problem with environmental fluctuation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-187387, filed Nov. 17, 2021, which is hereby incorporated by reference herein in its entirety.

What is claimed is:

1. An electrophotographic photosensitive member comprising a support and a surface layer, wherein the surface layer comprises a compound represented by following formula (1):

(1)

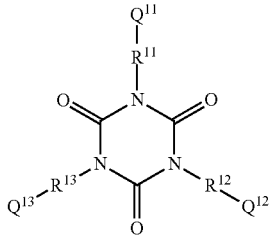

where, in the formula (1), $R^{11}$ to $R^{13}$ each independently represent an alkylene group having 1 to 6 carbon atoms, and $Q^{11}$ to $Q^{13}$ each independently represent a hydroxy group or a carboxy group.

2. The electrophotographic photosensitive member according to claim 1, wherein the content of the compound represented by the formula (1) in the surface layer is 0.01 to 1% by mass based on the total mass of the surface layer.

3. The electrophotographic photosensitive member according to claim 1, wherein the content of the compound represented by the formula (1) in the surface layer is 0.01 to 0.5% by mass based on the total mass of the surface layer.

4. The electrophotographic photosensitive member according to claim 1, wherein $Q^{11}$ to $Q^{13}$ in the formula (1) are hydroxy groups.

5. The electrophotographic photosensitive member according to claim 1, wherein $R^{11}$ to $R^{13}$ in the formula (1) are each independently alkylene groups having 1 or 2 carbon atoms.

6. The electrophotographic photosensitive member according to claim 1, wherein the surface layer comprises a polymer of a composition comprising a compound having a chain-polymerizable functional group.

7. The electrophotographic photosensitive member according to claim 6, wherein the composition comprises a compound represented by following formula (2):

(2)

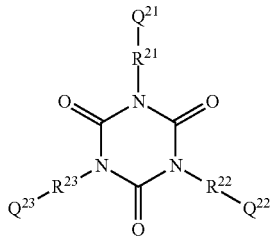

where, in the formula (2), $R^{21}$ to $R^{23}$ each independently represent an alkylene group having 1 to 6 carbon atoms, and $Q^{21}$ to $Q^{23}$ each independently represent an acryloyloxy group or a methacryloyloxy group.

8. The electrophotographic photosensitive member according to claim 6, wherein the composition comprises a compound represented by following formula (CT-1) or (CT-2):

(CT-1)

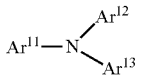

where, in the formula (CT-1), $Ar^{11}$ to $Ar^{13}$ each independently represent an aryl group which may be substituted by an alkyl group having 1 to 6 carbon atoms or a monovalent functional group represented by any of following formulas (P-1) to (P-3), provided that the compound represented by the formula (CT-1) has at least one monovalent functional group represented by any of the following formulas (P-1) to (P-3);

(P-1)

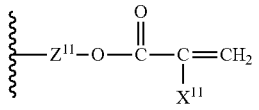

where, in the formula (P-1), $Z^{11}$ represents a single bond or an alkylene group having 1 to 6 carbon atoms, and $X^{11}$ represents a hydrogen atom or a methyl group;

(P-2)

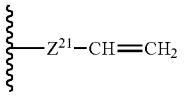

where, in the formula (P-2), $Z^{21}$ represents a single bond or an alkylene group having 1 to 6 carbon atoms;

(P-3)

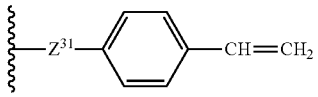

where, in the formula (P-3), $Z^{31}$ represents a single bond or an alkylene group having 1 to 6 carbon atoms;

(CT-2)

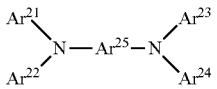

where, in the formula (CT-2), $Ar^{21}$ to $Ar^{24}$ each independently represent an aryl group which may be substituted by an alkyl group having 1 to 6 carbon atoms or a monovalent functional group represented by any of the following formulas (P-1) to (P-3), and $Ar^{25}$ represents an arylene group which may be substituted by an alkyl group having 1 to 6 carbon atoms or a monovalent functional group represented by any of the following formulas (P-1) to (P-3), provided that the compound represented by the formula (CT-2) has at least one monovalent functional group represented by any of the following formulas (P-1) to (P-3);

(P-1)

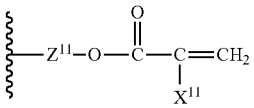

where, in the formula (P-1), $Z^{11}$ represents a single bond or an alkylene group having 1 to 6 carbon atoms, and $X^{11}$ represents a hydrogen atom or a methyl group;

(P-2)

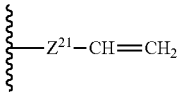

where, in the formula (P-2), $Z^{21}$ represents a single bond or an alkylene group having 1 to 6 carbon atoms;

(P-3)

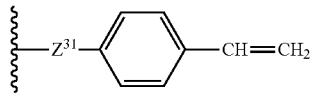

where, in the formula (P-3), $Z^{31}$ represents a single bond or an alkylene group having 1 to 6 carbon atoms.

9. The electrophotographic photosensitive member according to claim 8, wherein the composition comprises the compound represented by the formula (1), and wherein the content of the compound represented by the formula (1) in the composition is 0.015 to 1% by mass with respect to the content of the compound represented by the formula (CT-1) or (CT-2) in the composition.

10. The electrophotographic photosensitive member according to claim 1, wherein the electrophotographic photosensitive member has a charge generating layer provided on the support and a charge transporting layer provided on the charge generating layer, and wherein the surface layer is a layer provided on the charge transporting layer.

11. A process cartridge comprising:

an electrophotographic photosensitive member comprising a support and a surface layer, wherein the surface layer comprises a compound represented by following formula (1); and at least one unit selected from the group consisting of a charging unit, a developing unit, a transfer unit, and a cleaning unit, the process cartridge integrally supporting the electrophotographic photosensitive member and the at least one unit, and being detachably attachable to a main body of an electrophotographic apparatus:

(1)

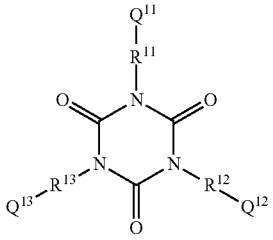

where, in the formula (1), $R^{11}$ to $R^{13}$ each independently represent an alkylene group having 1 to 6 carbon atoms, and $Q^{11}$ to $Q^{13}$ each independently represent a hydroxy group or a carboxy group.

12. An electrophotographic apparatus comprising:

an electrophotographic photosensitive member comprising a support and a surface layer, wherein the surface layer comprises a compound represented by following formula (1); and a charging unit, an exposing unit, a developing unit and a transfer unit:

(1)

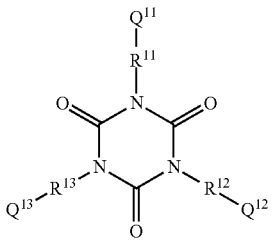

where, in the formula (1), $R^{11}$ to $R^{13}$ each independently represent an alkylene group having 1 to 6 carbon atoms, and $Q^{11}$ to $Q^{13}$ each independently represent a hydroxy group or a carboxy group.

* * * * *